US005230218A

United States Patent [19]

Clulow

[11] Patent Number: 5,230,218

[45] Date of Patent: Jul. 27, 1993

[54] SNOW MAKING EQUIPMENT

[76] Inventor: Malcolm G. Clulow, 7 Fieldfare Court, Spennells Valley, Kidderminister, England

[21] Appl. No.: 465,141

[22] PCT Filed: Jun. 19, 1989

[86] PCT No.: PCT/GB89/00685

§ 371 Date: Apr. 22, 1991

§ 102(e) Date: Apr. 22, 1991

[87] PCT Pub. No.: WO89/12793

PCT Pub. Date: Dec. 28, 1989

[30] Foreign Application Priority Data

Jun. 22, 1988 [GB] United Kingdom ..... 8814769
Feb. 14, 1989 [GB] United Kingdom ..... 8903304

[51] Int. Cl.[5] ..... F25C 3/04
[52] U.S. Cl. ..... 62/74; 472/90
[58] Field of Search ..... 62/59, 74, 347; 239/2.2; 472/90

[56] References Cited

U.S. PATENT DOCUMENTS 3,111,011 11/1963 Barlow ..... 62/341
3,257,815 6/1966 Brocoff et al. ..... 62/57
3,350,530 5/1966 Dean et al. ..... 272/3
4,637,222 1/1987 Fujiwara et al. ..... 62/244
4,790,531 12/1988 Matsui et al. ..... 472/90

FOREIGN PATENT DOCUMENTS 1057069 6/1979 Canada .
4803 3/1979 European Pat. Off. .
183112 4/1907 Fed. Rep. of Germany .
2583811 6/1985 France .
WO/86/029-36 5/1986 PCT Int'l Appl. .

*Primary Examiner*—William E. Tapolcai
*Attorney, Agent, or Firm*—Gifford, Groh, Sprinkle, Patmore and Anderson

[57] ABSTRACT

Apparatus and a method are provided whereby snow is made in an indoor environment over extended periods. Within the indoor environment temperature and humidity conditions are set up to enable snow to be produced by a spray of water in the air. Such conditions are maintained for an extended time by the use of thermal storage means. The thermal storage means is cooled to a low temperature by coolant in turn cooled by refrigeration apparatus. The thermal storage means uses a mass of relatively high conductivity material through which the coolant is circulated and the coolant is used to cool and dry air to be discharged into the indoor environment.

7 Claims, 3 Drawing Sheets

SNOW MAKING EQUIPMENT

Figure 1:
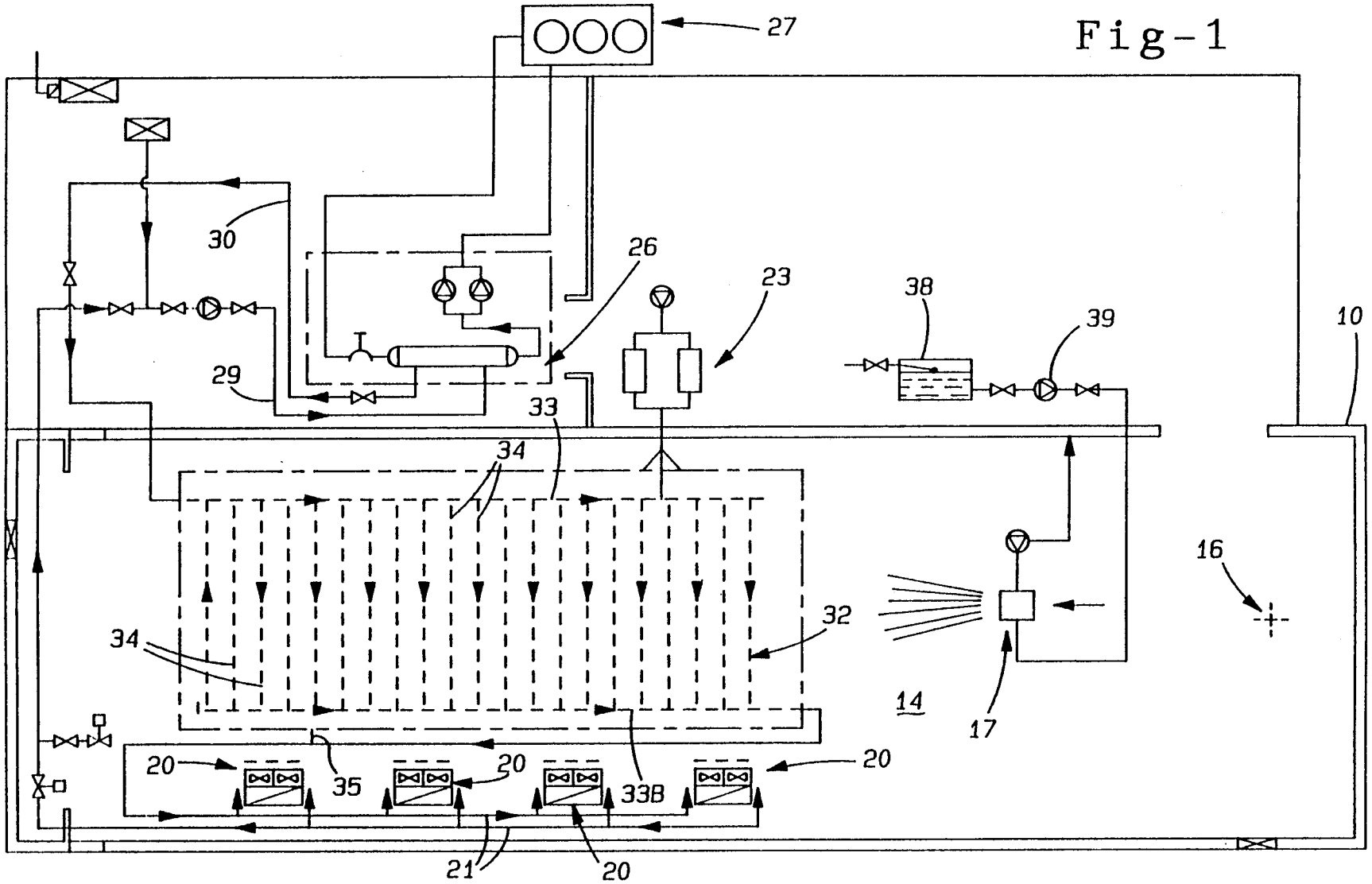

This invention relates to indoor snow making equipment.

For skiing and other winter sports activities it has been proposed to make real snow by artificial means in order to provide the surface for engaging in such activities when naturally produced snow cover is inadequate or absent. However it has been found that when equipment which has successfully produced snow cover outdoors is tried in an enclosed space, i.e., indoors, snow production has been unsatisfactory. In some cases although snow has been formed indoors it has only been for a brief duration and is insufficient for forming a layer for skiing etc.

It has been proposed in U.S. Pat. No. 3,250,530 to provide tunnels in which artificial snow may be laid down to give an all year round skiing facility. For this purpose air conditioning and temperature controlling facilities are proposed. However the teaching of this patent is insufficient to enable prolonged snow generation to be achieved.

An object of the invention is to provide snow making equipment which overcomes the problems encountered with snow making in confined or enclosed spaces.

According to one aspect of the invention there is provided a method of making snow within a confined envelope of air in which air within the envelope is cooled and maintained at a temperature below the freezing point of water and is maintained at a humidity of less than 100% at the selected temperature, and water droplets are discharged into the envelope in a flow of air to produce snow in said envelope over significant periods of time.

According to another aspect of the invention there is provided snow making equipment which comprises spray generating means for directing a flow of water and air into a cold atmosphere at a temperature below the freezing point of water, air drying means, air cooling means, and means for confining a body of said atmosphere within an envelope, the air crying means and the air cooling means drying and cooling the air in the envelope at least during the operation of the spray generating means to maintain the air within the envelope at below said freezing point and at a moisture content low enough to enable the water from the generating means to be turned into snow in said atmosphere for significant periods of time, whereby the water from the generating means turns into snow in said cold atmosphere.

Preferably the atmosphere is maintained at a temperature of −2° C. or less during snow making and the air at that temperature is maintained at a humidity of below 100%.

During the snow making operation a considerable quantity of latent heat is released and high refrigeration requirements are needed to provide enough cooling effect on the air in the envelope to maintain a temperature of −2° C. or below and to maintain humidity below 100%. Cold, dry air from the air cooling and drying means is introduced into the envelope for this purpose and to maintain the necessary dryness. Such air may be recirculated from the envelope through the air cooling and drying means or the air cooling and drying means may be appropriately located with in the envelope.

In order to reduce the capacity of refrigeration means supplying the air cooling means during snow production, which would otherwise be necessary, thermal storage means is provided so that the rate of cooling of the air in the envelope can be significantly greater than the nominal capacity of the refrigeration means by utilizing the storage capacity of the thermal storage means.

Air cooling means may also be provided for maintaining the envelope at below freezing point during intervals between snow production.

The thermal storage means may take any convenient form. Preferably the refrigeration means utilizes a secondary coolant, for example methylene chloride, which is cooled in a heat exchanger refrigeration cycle and the coolant is used to cool a mass of material of relatively high specific heat and conductivity. Alternatively a relatively large mass of coolant is employed which acts as the thermal storage means.

When the thermal storage means utilizes a mass of material the material is cooled by the coolant and the material may form a base on which a layer of snow is received. Accordingly the base may be inclined to the horizontal to provide a surface for receiving the snow for skiing etc. The mass of material may include alumina in particles bound by ice or contained within other solid material such as cement to provide a solid base.

The mass of material thereby forms a cold base for the snow to help to prevent it from melting.

Alternatively or in addition the base is provided by insulating material to help in preventing the snow from melting.

In addition to cooling an drying the air within the envelope it may be desirable to cool and optionally dry the air directed from the spray generating means to help maintain the desired air conditions in the envelope.

The thermal storage means is arranged of a size to match the cooling capacity of the refrigeration means with the cooling requirements of snow making, the cooling requirements being high during this operation. In practice it has been found that the cooling capacity of the refrigeration means may be of the order of $\frac{1}{8}$–1/20 of the maximum cooling requirement.

Preferably the coolant from the refrigeration means is passed in heat exchange relationship with the mass of material of the thermal storage means.

The snow generation means may take the form of an air discharge and a water discharge nozzle, the water being discharged in fine droplets into the flow of air, or air and water may be discharged together through the same nozzle.

Preferably the air is kept at a temperature of below −2° C. or less by discharging cooled and dried air into the envelope during discharge of the water. Conveniently the air is recirculated from the envelope and over cooling means before discharge back into the envelope. Alternatively the cooling means may be contained within the envelope with fans provided to pass air over the cooling and drying means.

The cooling means preferably includes thermal storage means maintained at a cold temperature in the range −5° C. to −30° C., conveniently about −20° C., but the temperature of the thermal storage means rises during the snow making operation since the refrigeration means by which the thermal storage means is cooled has a lower refrigeration capacity than the needs of the system during cooling of the air when snow making is taking place.

Figure 2:
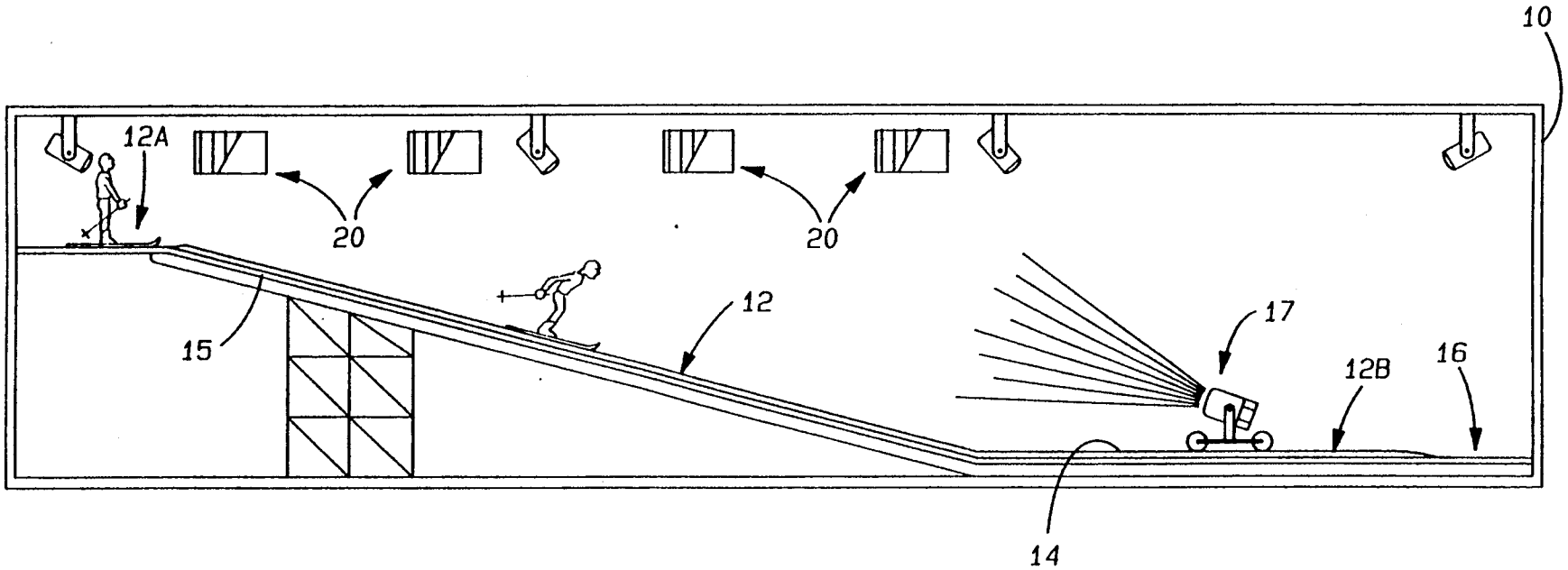
Figure 3:
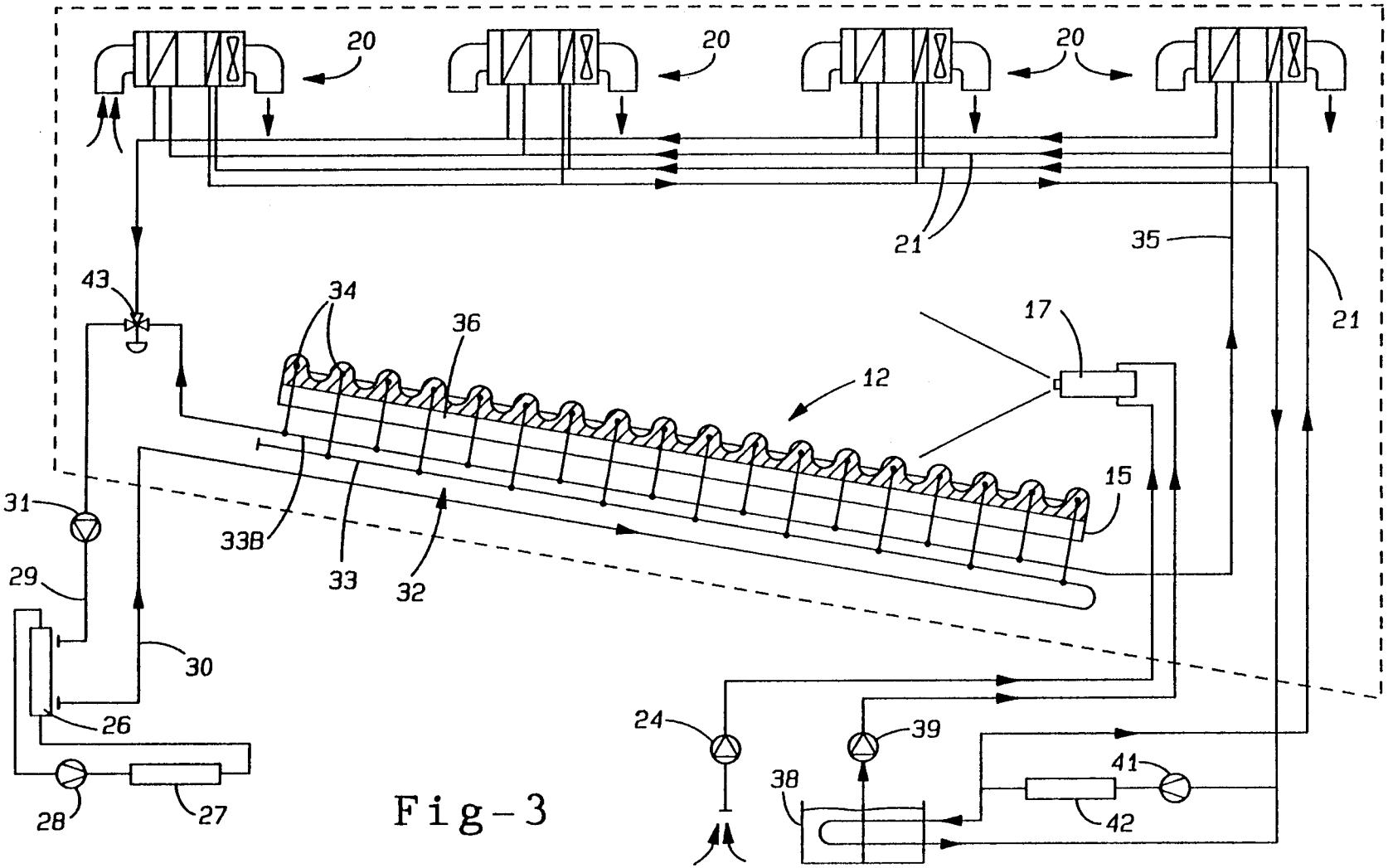

Further features of the invention will appear from the following description of an embodiment of the invention given by way of example and with reference to the drawings in which:

FIG. 1 is a schematic plan view of snow making equipment for indoor snow making, FIG. 2 is a sectional side elevation of the equipment of FIG. 1, FIG. 3 shows schematically a modified version of the arrangement of FIGS. 1 and 2.

Referring to the drawings snow making equipment is shown which is installed in a building defining an air envelope in which snow is to be formed. The building may be of any convenient size and shape and in the illustrated arrangement the building is shown at 10 and is insulated and of generally rectangular shape in plan and cross section. A surface to be covered in snow is shown at 12 and the surface slopes downwards from its upper end 12A to its lower end 12B terminating at the ends in an upper platform 13 and a lower run off area 14 respectively. At one end of the run off area 14 is a gully and drain area 16 for melted snow.

The surface 12 is formed over its sloping part by a structure 15 suitably supported and, as will be described, incorporating a thermal store. The volume V of the building over the surface 12 constitutes the air envelope.

As shown a snow making machine 17 is located on the area 14 and is arranged to form snow and direct it as it is formed onto the surface 12 and for this purpose the machine 17 is mobile. Alternatively the machine 17 may be mounted on the building above the surface 12 to be mobile or fixed and to direct the snow downwards to the surface 12. More than such machine may be provided.

As an alternative the surface 12 may be located on the ground surface when the ground contours are suitably sloped.

The snow making machine 17 is supplied with water and with cooled air which may be dried. The machine directs cold water supplied by a pump 39 from nozzles (not shown) and air from a fan or air compressor 24 (FIG. 3) in known manner to produce a pattern of water and air which creates a plume of air and entrained small water droplets which form as snow for deposition on the surface 12.

In order to create the conditions which enable the water and air to become snow during discharge certain characteristics should prevail and be maintained in the building.

Thus the air within the building should be kept below 0° C. and preferably at between =2° C. and −10° C. during snow making. This is achieved by providing fans 20 which pass air from within the envelope in heat exchange relationship with coolant supplied to each fan 20 along coolant ducts 21. Normally after snow discharge has ceased the air in the building can be allowed to rise to a temperature no higher than say −1° C.

Air for the snow making machine 17 is supplied from a compressor 24 which may include an air drying device 23.

Refrigeration may be achieved by means of a refrigerator consisting of an evaporator unit 26 comprising a heat exchanger cooling the second coolant and located in the building, and a compressor 28 and a condenser unit 27 located externally. The evaporator unit 26 receives coolant for cooling through an inlet conduit 29 and the coolant leaves through an outlet 30. The cold coolant at, for example, −30° C. is pumped by pump 31 to a thermal storage system 32 in the structure 15. The system 32 includes an array of pipes having longitudinal or header portions 33 interconnected by transverse portions 34. A return header pipe 33B connects with a pipe 35 which carries the coolant to the fans 20 through the coolant ducts 21 and with a pipe 37 which connects through a control valve 43 (FIG. 3) to the conduit 29.

The fans 20 pass air from the space V over coils which can be cooled either by coolant from evaporator 26, by direct expansion of refrigerant from condenser 27, or by a separate cold air supply, and air from these coils may be slightly reheated in order to provide a suitable level of dryness to as to maintain the humidity of the body of air in the envelope at less than 100%.

In the thermal storage system the pipes 33 and 34 are embedded in a suitable material 36 with relatively high thermal conductivity and specific heat, for example particulate activated alumina (aluminum oxide) or even ice, which lies on an insulated surface of, for example, polystyrene slab. In operation the snow is laid on the activated alumina layer or other material which is kept cold by the coolant. The alumina layer may be embedded in ice or bonded together with cement or concrete such that its thermal conductivity is maintained. The coolant in the thermal storage system 22 may be methylene chloride or any other fluid which possesses a low freezing point and low viscosity and within the system there is sufficient volume of coolant and alumina to provide an adequate store for cooling purposes during snow generation. Thus, the refrigeration means 26, 27 need only provide, say, ⅛ to 1/20 of the total cooling requirement during these operations, the remainder being provided by the thermal storage system. It is envisaged with this arrangement snow making can be provided continuously for extended periods of say 2 hrs or more to provide a layer of snow over a portion of the surface 12. Thereafter after recooling the thermal storage means a further layer of snow over another portion of the surface 12 can be supplied so that a layer over the whole surface is built up progressively and can be maintained over lengthy periods, it only being necessary to work the layer of snow from time to time to provide a clean surface layer of snow.

Water for the snow generator 17 is supplied from the mains supply through a tank 38 to a pump 39 and then to the machine 17 and the rate of supply of water to the machine 17 can be controlled according to the desired rate of generation of snow. Water in the tank is cooled preferably by a supplementary refrigeration compressor 41 and condenser 42 arrangement (FIG. 3).

After a snow making operation is completed the cooling requirement of the envelope is reduced since it is only required to maintain a low temperature in the body of air consistent with preventing the snow from melting. During snow making the latent heat produced during snow formation is greater, hence the provision of the thermal storage which enables a relatively low capacity refrigeration unit to provide enough cooling effect to maintain snow making for length periods.

The cooling effect during non-snow making periods may be provided from a separate refrigeration source which may cool air directed from a separate fan to the air provided during snow making, such as through the refrigeration compressor and condenser arrangement 41, 42 of FIG. 3 which in that arrangement also cools the snow gun water in tank 38. The supplementary refrigeration arrangement 41, 42 is also arranged so that it may be provide the necessary cooling requirement of the fans 20 for example during a non-snowmaking period. For this purpose the arrangement is coupled to the air supply heat exchange arrangement of the fans 20, as shown in FIG. 3.

Instead of the snow making machine 17 being ground mounted it may be carried on a gantry (not shown) mounted above the slope and arranged to follow the line of the slope at a predetermined distance above the slope 12. The machine 17 may be arranged to be withdrawn from the envelope to enable maintenance and ice removal to take place.

The structure 15 is preferably insulated on its underside and any space below the structure utilized for support services or for housing other associated facilities. The space or other areas may be heated by the heat generated by the refrigeration means condenser unit and to this end all or a portion of the heat generated may be stored for use as necessary.

Pressure, fluid flow, temperature and humidity sensors in the building, valves and other control means are provided to monitor and control each of the functions to ensure satisfactory operation and maintenance of the equipment.

In a particular embodiment of the invention it has been found that the following cycle of operation can be followed assuming that adequate snow cover has previously been provided.

| | |
|---|---|
| Snowmaking period | 3 hours |
| Use e.g. skiing | 17 hours |
| Snow grooming/maintenance | 3 hours |
| Conditioning the air in the envelope prior to snowmaking | 1 hour |

In this example it will be seen that 20 hours is provided for recharging the thermal store.

Any snow removed from the envelope can be used to cool the water in the storage tank 38.

Because of the use of the thermal store the cooling load which is normally required during snow making of say 1200 Kw can be reduced by up to twentyfold to 60 Kw reducing the capital cost of the refrigeration capacity and, at least to some extent, making the use of off-peak electricity supply possible.

In the illustrative embodiment the air temperature and humidity during snow making are between −3° C. at 85% relative humidity and −6° C. also at 85% relative humidity and is dependent on the kind of snow required.

The pipes 34 in the structure 15 may be at 1.0 m centres and the surface 12 may be convoluted or corrugated, as shown in FIG. 3, to hold the snow in place on steep gradients and to ensure an even temperature distribution over the surface.

I claim:

1. A method of making snow within a confined envelope of cold air wherein the envelope is defined by a building structure and is substantially confined within the building structure, part of the envelope defining a surface on which the snow is to be deposited, the method comprising the steps of:

cooling the air in the internal space of the envelope to a temperature below the freezing point of water by introducing cold air into the envelope, discharging cold dry air into a body of air within the envelope to maintain the body of air in the envelope at a temperature below freezing and at a humidity of below 100% during snow making, discharging water droplets with a flow of gas into the body of air so that the water droplets are transformed into snow in said body of air and are received on said surface, and wherein discharge of the cold dry air into the envelope is separate from the discharge of the gas with the water droplets.

2. The method according to claim 1, further comprising the step of recirculating the cold, dry air introduced into the body of air in the envelope from said body through cooling means before being returned into the body of air.

3. The method according to claim 1, further comprising the step of cooling the air by cooling means located within said envelope and the air from said envelope is directed through said cooling means, the air leaving the cooling means and passing into the envelope being of humidity less than 100% and a temperature at or below −2° C.

4. The method according to claim 1 further comprising the step of providing refrigeration means and thermal storage means, the refrigeration means cools the thermal storage means at least during non-snow making periods, and the thermal storage means includes a mass of cold material and provides a source for cooling at least the cold, dry air discharged into the body of air.

5. The method according to claim 4 further comprising the step of the refrigeration means supplying coolant to the thermal storage means and the coolant communicating with cooling means for cooling the cold, dry air, at least during snow making.

6. The method according to claim 4 wherein the thermal storage means has, when changed, a thermal storage capacity for cooling the cold, dry air which is several times the cooling capacity of the refrigeration means.

7. A method of making snow within a confined envelope of cold air wherein the envelope is defined by a building structure and is substantially confined within the building structure, part of the envelope defining a surface on which the snow is to be deposited, the method comprising the steps of:

cooling the air in the internal space of the envelope below the freezing point of water by introducing cold air into the envelope, maintaining a body of air in the envelope at a temperature below freezing and at a humidity of below 100% during snow making, discharging water droplets with a flow of air into the body of air so that the water droplets are transformed into snow in said body of air and are received on said surface, there being at least two discharges of air into the envelope, air being discharged with the water, and cold, dry air being discharged into the body of air in the envelope at least during snow making, the method further comprising using refrigeration means and thermal storage means, the thermal storage means including a mass of cold material to provide a source for cooling at least the cold, dry air discharged into the body of air.

* * * * *

UNITED STATES PATENT AND TRADEMARK OFFICE

CERTIFICATE OF CORRECTION

PATENT NO. : 5,230,218

DATED : July 27, 1993

INVENTOR(S) : Malcolm G. Clulow

It is certified that error appears in the above-identified patent and that said Letters Patent is hereby corrected as shown below:

Column 3, line 50, delete " =2 " and insert -- -2 --.

Signed and Sealed this

Nineteenth Day of July, 1994

Bruce Lehman

*Attest:*

BRUCE LEHMAN

*Attesting Officer*

*Commissioner of Patents and Trademarks*